US009295333B2

(12) United States Patent
Yin et al.

(10) Patent No.: US 9,295,333 B2
(45) Date of Patent: Mar. 29, 2016

(54) FOLDABLE LEG REST

(71) Applicant: Wan-Yu Li, Taipei (TW)

(72) Inventors: Qing-Kun Yin, Guangdong (CN); Chin-Chen Chang, Taipei (TW)

(73) Assignee: Wan-Yu Li, Taipei (TW)

( * ) Notice: Subject to any disclaimer, the term of this patent is extended or adjusted under 35 U.S.C. 154(b) by 0 days.

(21) Appl. No.: 14/314,353

(22) Filed: Jun. 25, 2014

(65) Prior Publication Data

US 2015/0374133 A1 Dec. 31, 2015

(51) Int. Cl.
*A47C 7/50* (2006.01)

(52) U.S. Cl.
CPC ..... *A47C 7/506* (2013.01)

(58) Field of Classification Search
CPC ..... A47C 1/02; A47C 1/034; A47C 1/0342; A47C 7/50; A47C 7/503; A47C 7/506
See application file for complete search history.

(56) References Cited

U.S. PATENT DOCUMENTS 2,514,655 A * 7/1950 Luketa ..... A47C 1/037 297/145
6,095,610 A * 8/2000 Okajima ..... B60N 2/4495 297/423.2
6,227,489 B1 5/2001 Kitamoto et al.
7,121,627 B2 * 10/2006 Gaikwad ..... A47C 7/506 297/423.28
7,229,134 B2 * 6/2007 Ito ..... B60N 2/0232 297/423.26
2012/0091779 A1 * 4/2012 Chang ..... B60N 3/063 297/423.3
2013/0045824 A1 * 2/2013 Yin ..... A47C 7/506 474/148
2013/0045825 A1 * 2/2013 Yin ..... A47C 7/506 474/150
2013/0313882 A1 * 11/2013 Yin ..... A47C 7/506 297/423.22

FOREIGN PATENT DOCUMENTS

EP 1097864 A1 5/2001

OTHER PUBLICATIONS

Combined Search and Examination Report for GB1311550.6, Dec. 18, 2013.

* cited by examiner

*Primary Examiner* — Philip Gabler
(74) *Attorney, Agent, or Firm* — The Weintraub Group, P.L.C.

(57) ABSTRACT

A foldable leg rest has a seat, a folding frame and a drive mechanism. The folding frame is pivotally connected to the seat. The drive mechanism includes a first actuator and a second actuator. The first actuator has a front end and a rear end. The front end of the first actuator is pivotally connected to the folding frame. The second actuator has a front end and a rear end. The rear end of the second actuator is pivotally connected to the seat. The front end of the second actuator is secured to the rear end of the first actuator. The first actuator and the second actuator are actuated to pivot the folding frame to a horizontal plane in which the seat lies.

8 Claims, 10 Drawing Sheets

FOLDABLE LEG REST

BACKGROUND OF THE INVENTION

1. Field of the Invention

The present invention relates generally to chairs, and more particularly to a foldable leg rest applied to a chair for allowing the legs of a sitter to stretch horizontally.

2. Description of the Related Art

Chairs allow people to sit thereon and support weights of sitters. Chairs are varied in structure and function. With reference to FIG. 9, an electric car seat or a massage chair substantially comprises a seat 90, a backrest 91, a folding frame 92 and a drive mechanism. The seat 90 has a front end and a rear end. The backrest 91 is pivotally connected to the rear end of the seat 90. The folding frame 92 is pivotally connected to the front end of the seat 90. The drive mechanism is mounted between the seat 90 and the folding frame 92. With reference to FIG. 10, the drive mechanism is actuated to pivot the folding frame 92 relative to the seat 90 to construct a foldable leg rest. Therefore, the legs of a sitter can be stretched and placed on the folding frame 92.

The drive mechanism includes a pivot arm 93 and an actuator 94. The pivot arm 93 has a front end and a rear end. The front end of the pivot arm 93 is secured to the folding frame 92. The actuator 94 is a motorized fader having a cylindrical body 941 and a telescopic rod 942. The cylindrical body 941 is pivotally connected to the seat 90. The telescopic rod 942 is slidably received in the cylindrical body 941 and is extendable and retractable relative to the cylindrical body 941. The telescopic rod 942 has a front end extending from the cylindrical body 941 and pivotally connected to the rear end of the pivot arm 93. The folding frame 92 is pivoted forward to be unfolded when the actuator 94 is operated to extend the telescopic rod 942. Likewise, the folding frame 92 is pivoted backward to be folded when the actuator 94 is operated to retract the telescopic rod 942.

However, the length of the telescopic rod 942 is limited because the actuator 94 is disposed within the space between the seat 90 and the folding frame 92, such that the actuator 94 cannot provide sufficient stroke to pivot the folding frame 92 to a horizontal plane in which the seat 90 lies. Accordingly, the legs of the sitter cannot be horizontally stretched on the folding frame 92, thereby reducing sitting comfort.

To overcome the shortcoming, the present invention provides a foldable leg rest that allows the legs of a sitter to stretch horizontally.

SUMMARY OF THE INVENTION

A foldable leg rest in accordance with the present invention comprises a seat, a folding frame and a drive mechanism. The folding frame is pivotally connected to a front end of the seat. The drive mechanism is mounted between the seat and the folding frame and includes a first actuator and a second actuator. The first actuator has a front end and a rear end. The front end of the first actuator is pivotally connected to the folding frame. The second actuator has a front end and a rear end. The rear end of the second actuator is pivotally connected to the seat. The front end of the second actuator is secured to the rear end of the first actuator. The first actuator and the second actuator are actuated to pivot the folding frame relative to the seat. The first actuator and the second actuator provide two strokes such that the folding frame can be pivoted to a horizontal plane in which the seat lies. Therefore, the legs of a sitter can be horizontally stretched on the folding frame, thereby enhancing sitting comfort.

DETAILED DESCRIPTION OF THE PREFERRED EMBODIMENT

Figure 1:
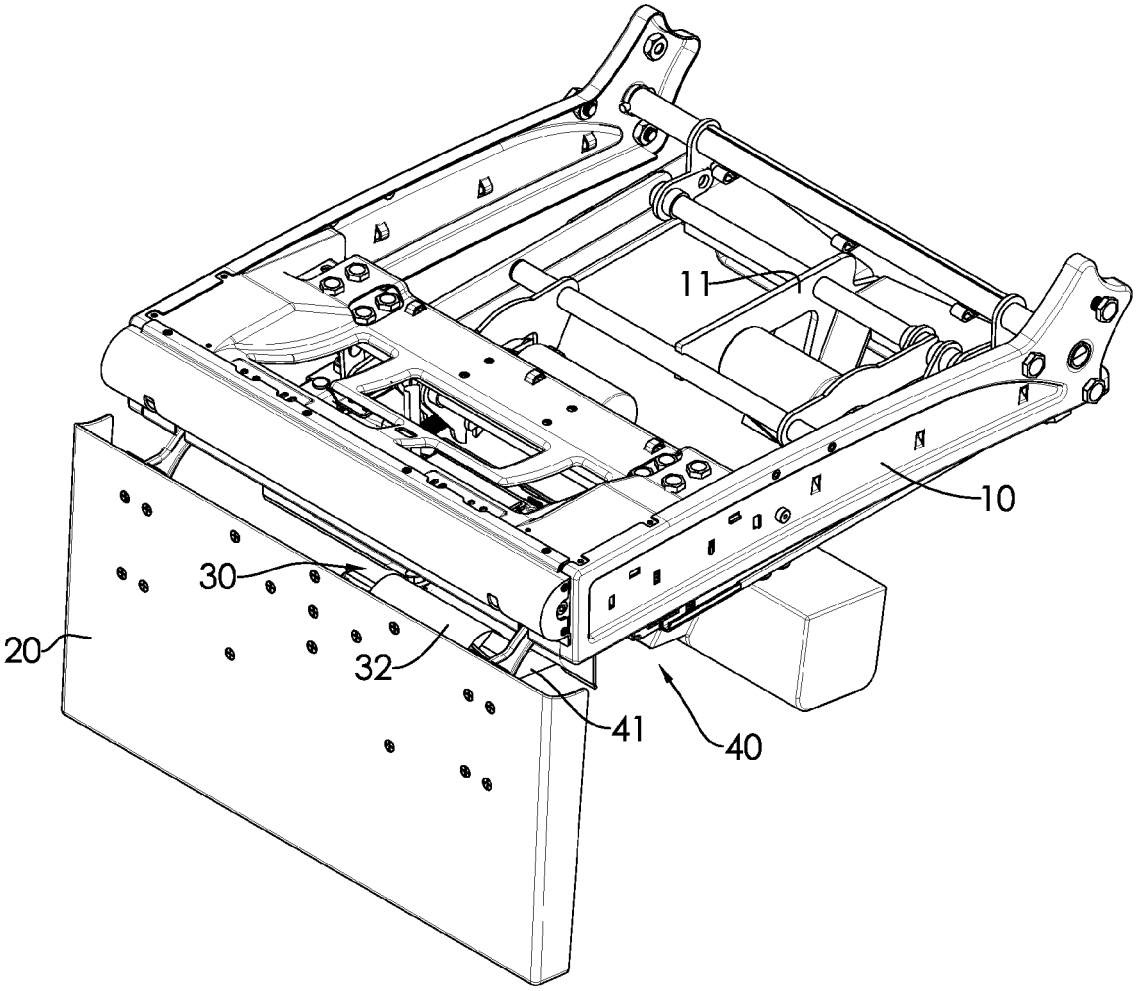
FIG. 1 is a perspective view of a foldable leg rest in accordance with the present invention.
Figure 2:
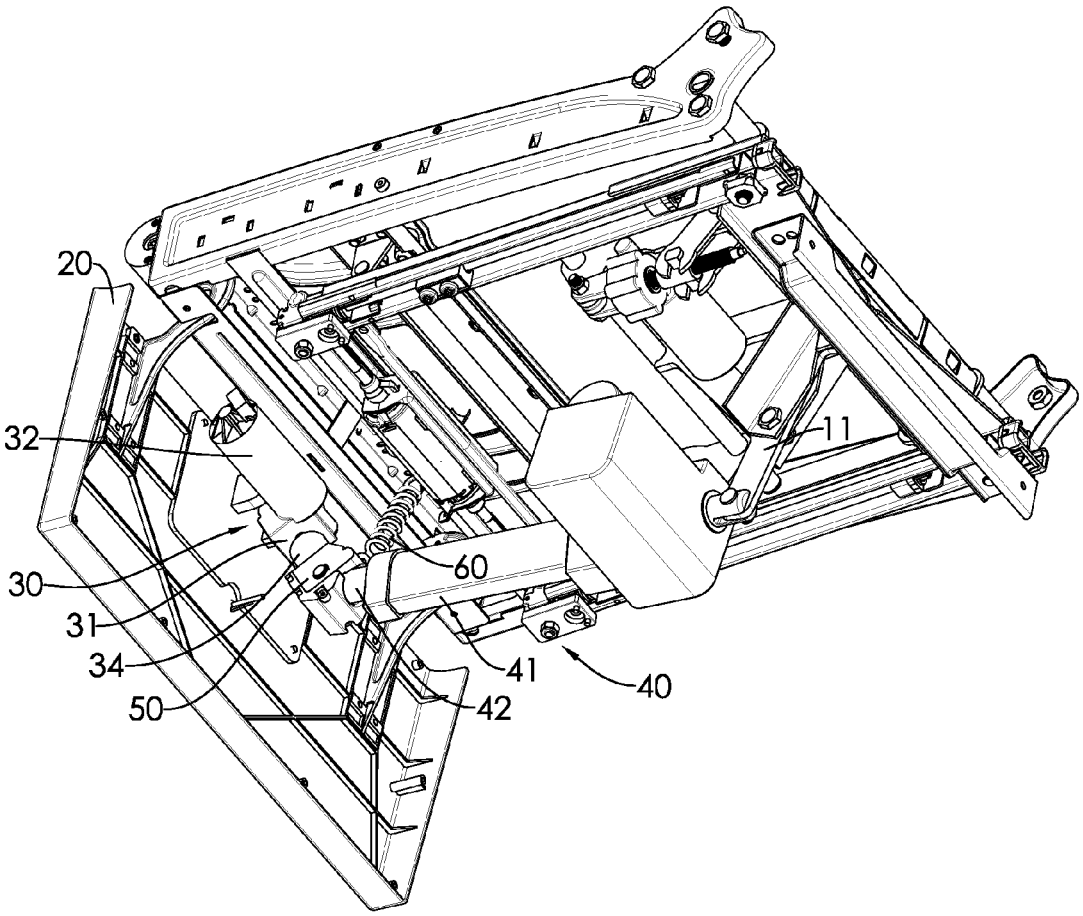
FIG. 2 is another perspective view of the foldable leg rest of FIG. 1.
Figure 3:
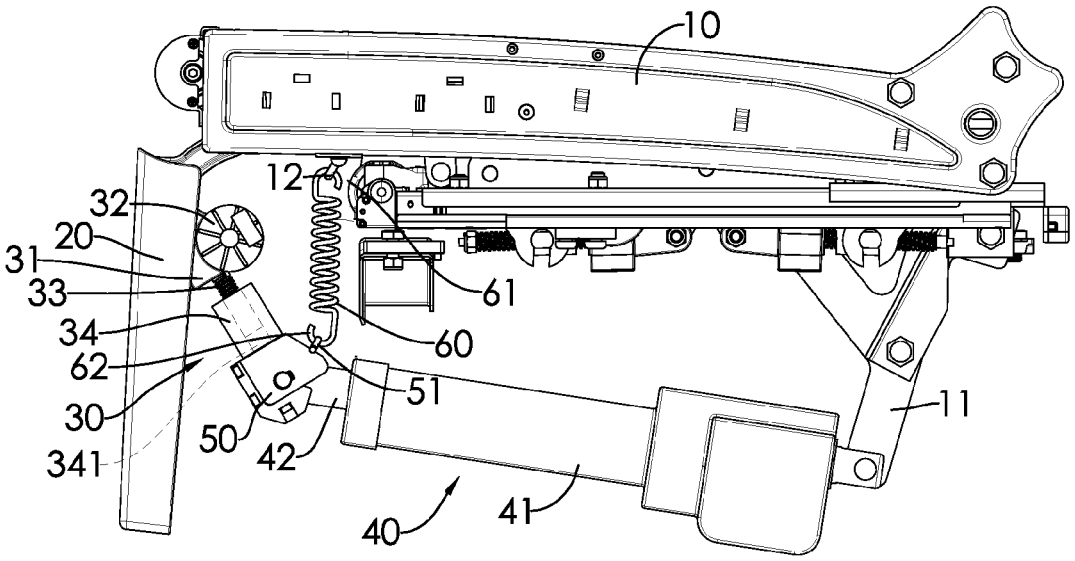
FIG. 3 is a side view of the foldable leg rest of FIG. 1.

With reference to FIGS. 1 to 3, a foldable leg rest in accordance with the present invention comprises a seat 10, a folding frame 20 and a drive mechanism.

The folding frame 20 is pivotally connected to a front end of the seat 10. The seat 10 and the folding frame 20 are conventional and thus detailed descriptions thereof are omitted.

The drive mechanism is mounted between the seat 10 and the folding frame 20 and includes a first actuator 30 and a second actuator 40.

The first actuator 30 has a front end and a rear end. The front end of the first actuator 30 is pivotally connected to the folding frame 20. The second actuator 40 has a front end and a rear end. The rear end of the second actuator 40 is pivotally connected to the seat 10. The front end of the second actuator 40 is secured to the rear end of the first actuator 30. The first actuator 30 and the second actuator 40 are actuated to pivot the folding frame 20 relative to the seat 10.

A preferred embodiment is described below.

A pivot piece 11 extends downward from a rear central portion of the seat 10, and an upper eye 12 is mounted on a front central portion of a bottom surface of the seat 10.

The first actuator 30 has a pivot member 31, a motor 32, a threaded rod 33 and a holder 34. The pivot member 31 is pivotally connected to an inner surface of the folding frame 20 facing the seat 10. The motor 32 is secured to the pivot member 31. The threaded rod 33 is driven by the motor 32. The holder 34 has a threaded hole 341 for receiving the threaded rod 33. The threaded rod 33 is extendable and retractable relative to the holder 34.

The second actuator 40 is a motorized fader having a cylindrical body 41 and a telescopic rod 42. The cylindrical body 41 is pivotally connected to a lower end of the pivot piece 11 on the seat 10. The telescopic rod 42 is slidably received in the cylindrical body 41, is extendable and retractable relative to the cylindrical body 41 and has a front end extending from the cylindrical body 41. The motorized fader is conventional and thus a detailed description thereof is omitted.

The drive mechanism further includes a joint 50 and a resilient member 60.

The joint 50 has a front end and a rear end. The front end of the joint 50 is secured to the holder 34 of the first actuator 30.

The rear end of the joint 50 is secured to the front end of the telescopic rod 42 of the second actuator 40. A lower eye 51 is mounted on a top of the joint 50.

The resilient member 60 is connected between the seat 10 and the joint 50. The resilient member 60 is a tension coil spring having an upper hook 61 and a lower hook 62. The upper hook 61 engages the upper eye 12 on the seat 10. The lower hook 62 engages the lower eye 51 on the joint 50.

Figure 4:
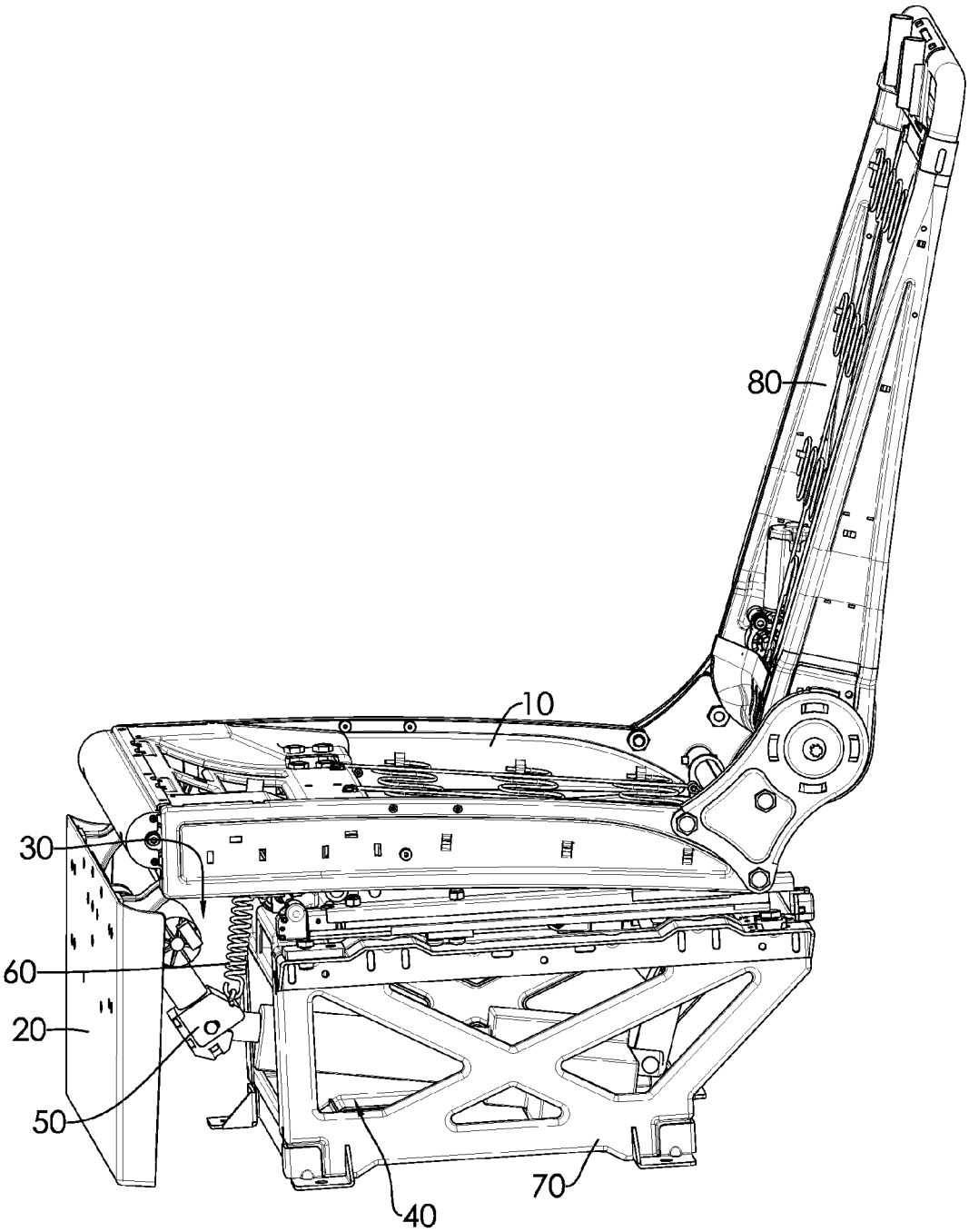
FIG. 4 is a perspective view of a chair with the foldable leg rest of FIG. 1.
Figure 5:
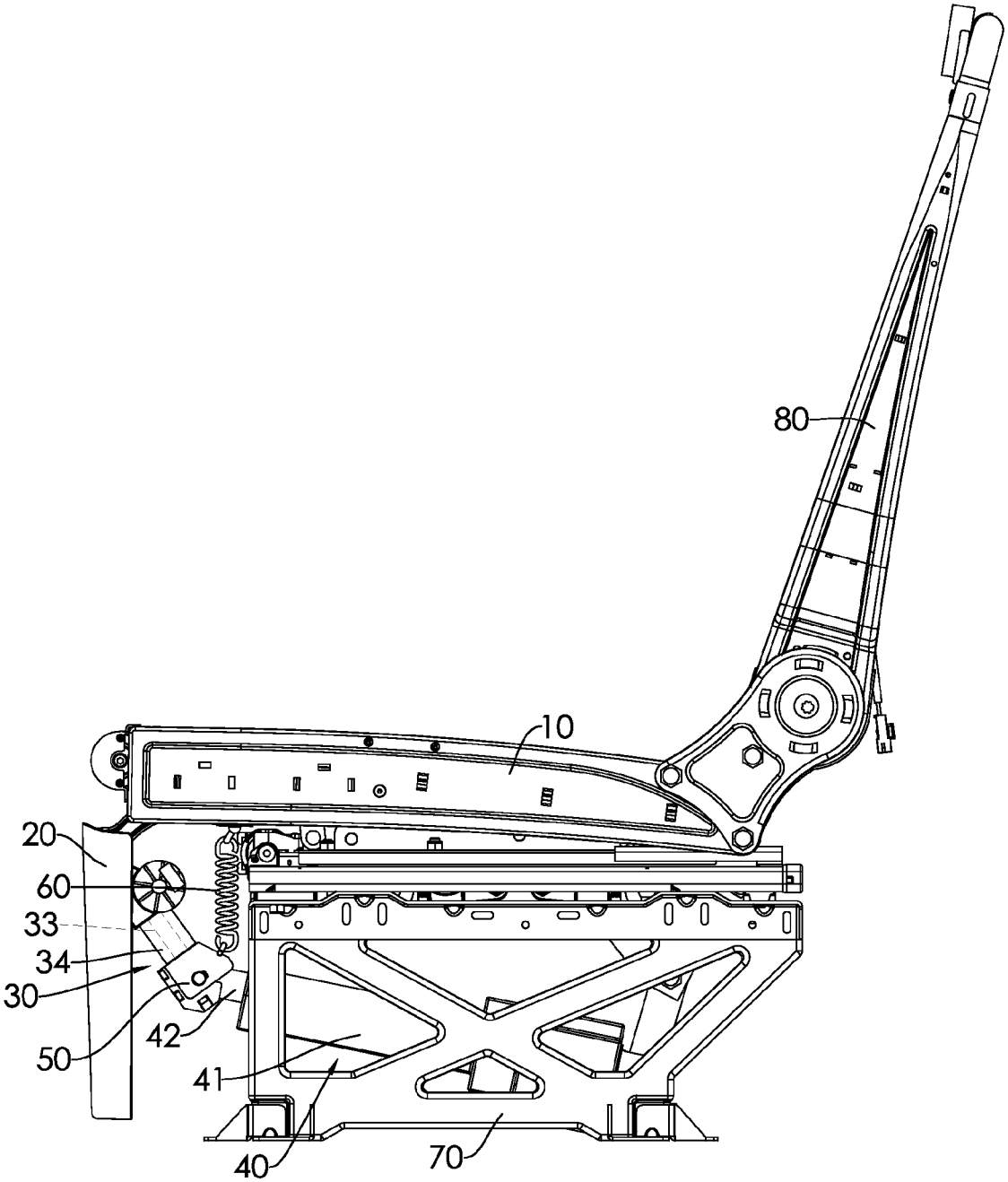
FIG. 5 is a side view of the chair of FIG. 4 showing that the foldable leg rest is in a non-actuated state.
Figure 6:
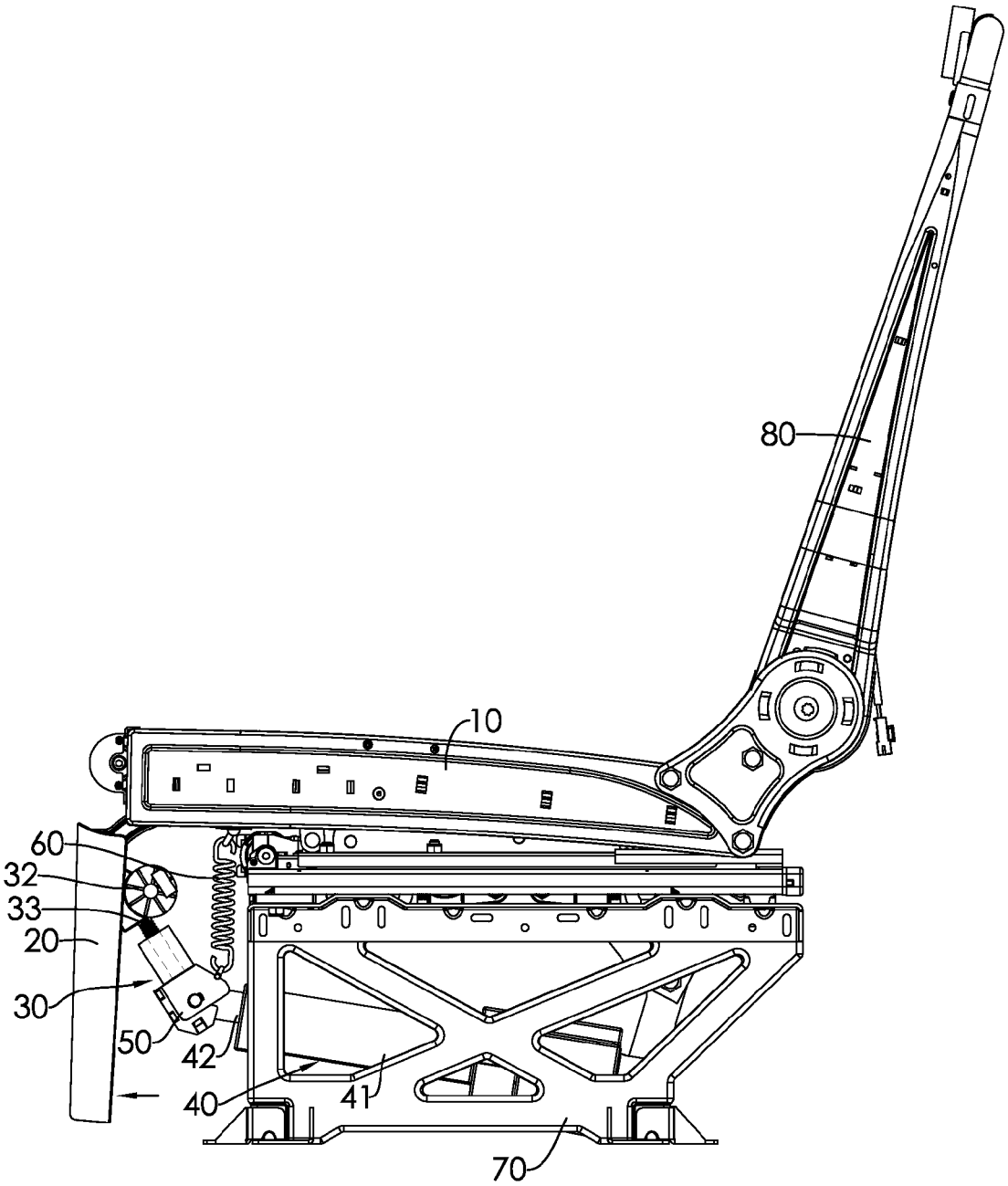
FIGS. 6 to 8 are side views of the chair of FIG. 4 showing that the foldable leg rest is in an actuated state.
Figure 7:
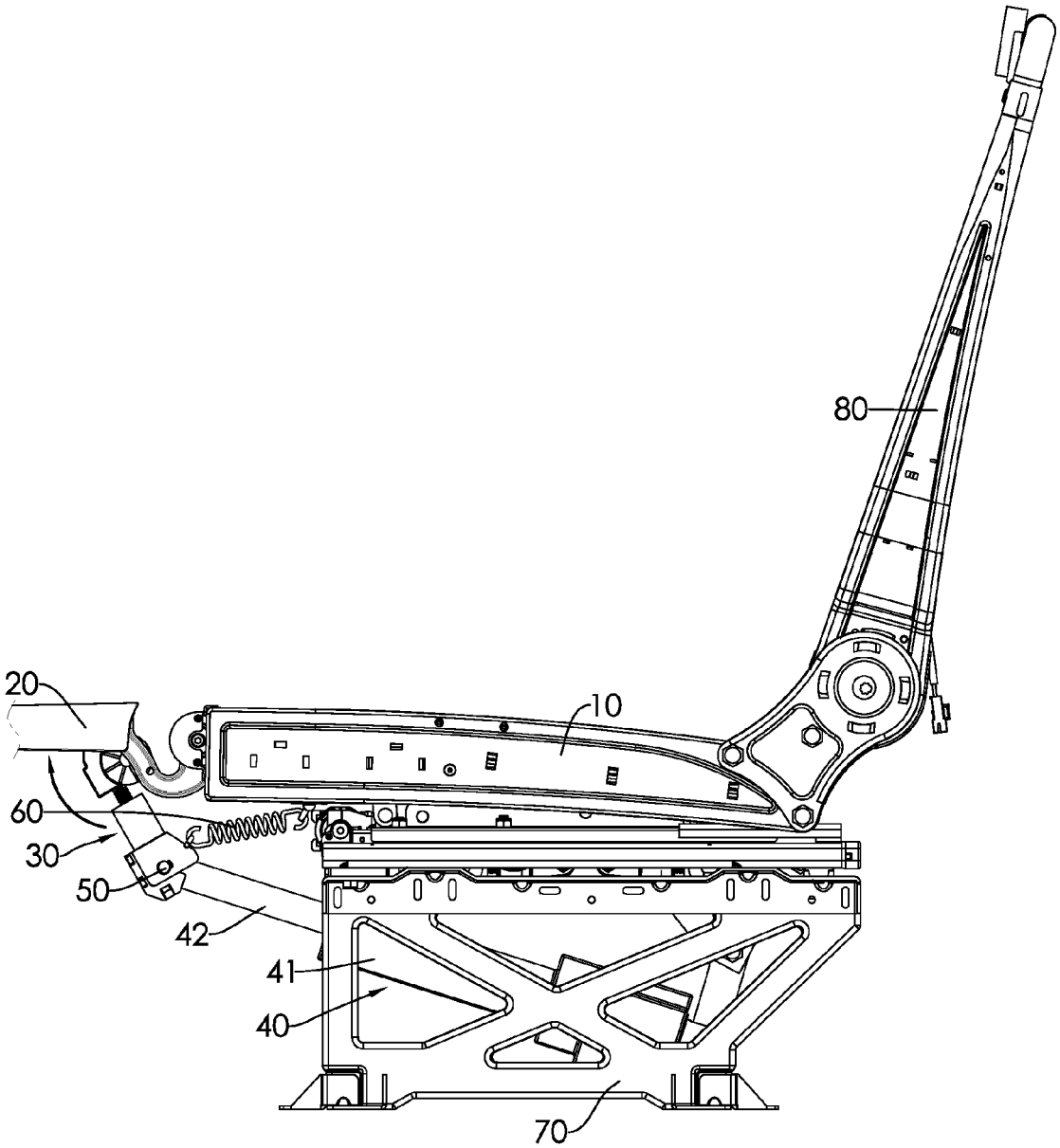
Figure 8:
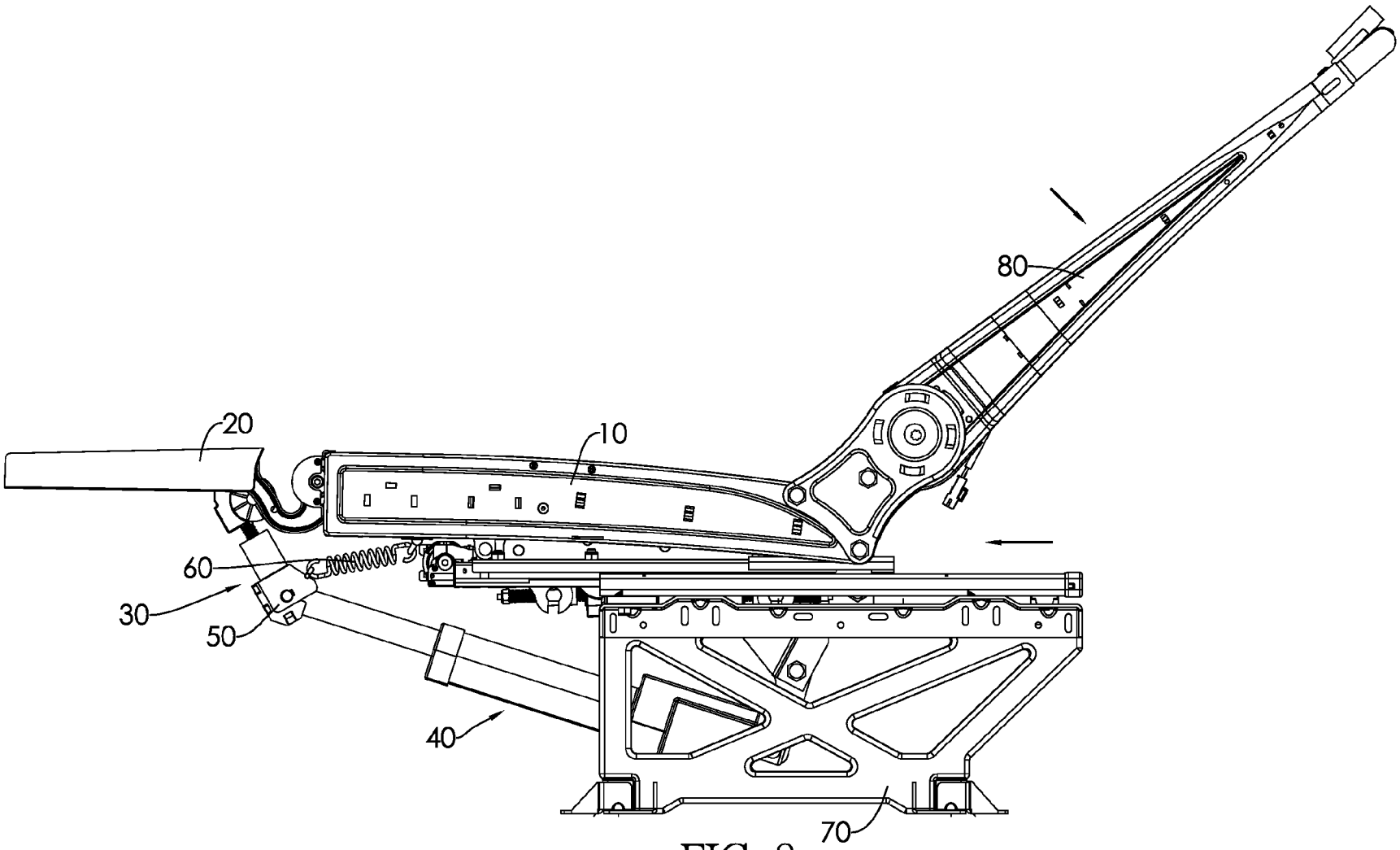
Figure 9:
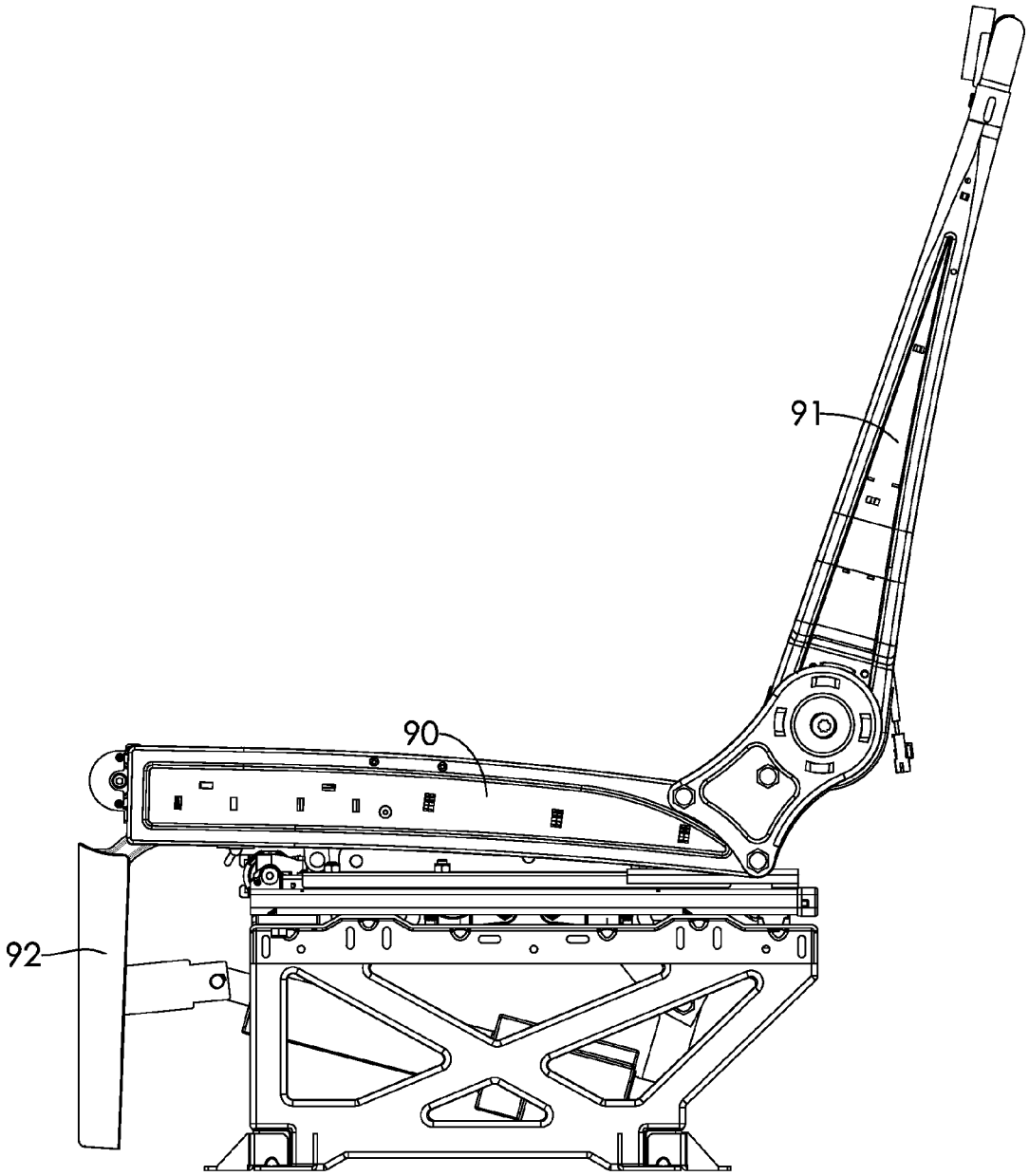
FIG. 9 PRIOR ART
FIG. 9 is a side view of a conventional chair in accordance with the prior art showing that the foldable leg rest is in a non-actuated state.
Figure 10:
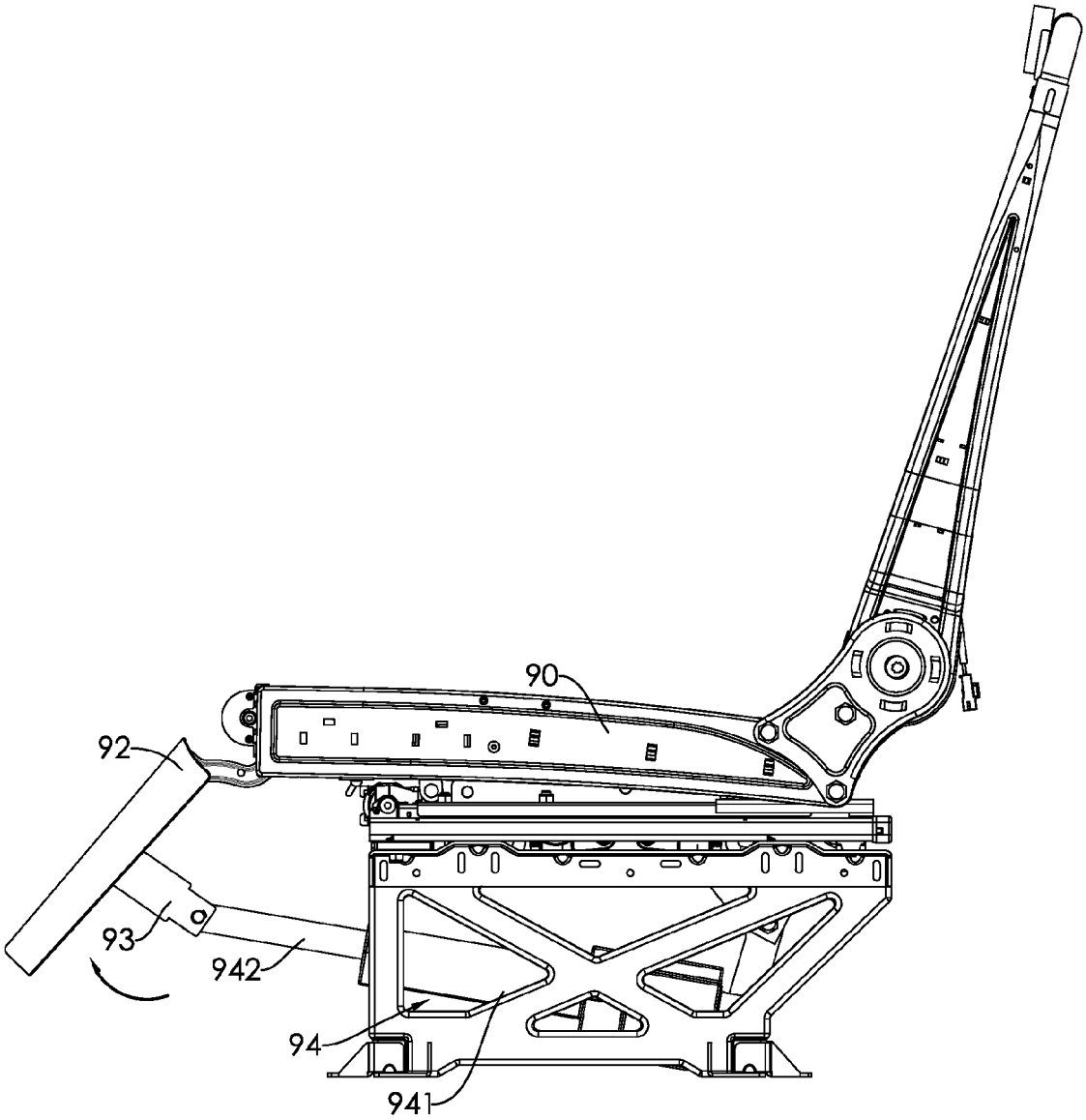
FIG. 10 PRIOR ART
FIG. 10 is side view of the conventional chair of FIG. 9 showing that the foldable leg rest is in an actuated state.

With reference to FIG. 4, the foldable leg rest in accordance with the present invention is applied to a chair that comprises a seat base 70 and a backrest 80. The seat 10 is movably mounted on the seat base 70. The backrest 80 is pivotally connected to a rear end of the seat 10. With reference to FIG. 5, the leg rest is in a folded state. To unfold the leg rest, with reference to FIG. 6, the motor 32 of the first actuator 30 is operated to extend the threaded rod 33 and thus pivot the folding frame 20 forward relative to the seat 10. With reference to FIG. 7, the second actuator 40 is operated to extend the telescopic rod 42 and thus further pivot the folding frame 20 forward relative to the seat 10. With reference to FIG. 8, the seat 10 is adjustable to be moved forward relative to the seat base 70, and the backrest 80 is adjustable in angle relative to the seat 10 to meet different sitters' needs.

The leg rest in accordance with the present invention includes the first and second actuators 30, 40 providing two strokes such that the folding frame 20 can be pivoted to a horizontal plane in which the seat 10 lies. Therefore, the legs of a sitter can be horizontally stretched on the folding frame 20, thereby enhancing sitting comfort. In addition, the joint 50 and the resilient member 60 allow the folding frame 20 to smoothly pivot and maintain stability in both an unfolded state and a folded state.

To fold the leg rest, with reference to FIG. 5, the first actuator 30 is operated to retract the threaded rod 33 and the second actuator 40 is operated to retract the telescopic rod 42, and thus the folding frame 20 is pivoted to be vertical and perpendicular to the seat 10. Therefore, the area of the leg rest is reduced for convenience in storage and shipment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A foldable leg rest comprising:

(a) a seat;

(b) a folding frame pivotally connected to a front end of the seat;

(c) a drive mechanism mounted between the seat and the folding frame, the drive mechanism including:

(1) a first actuator having:

(i) a front end pivotally connected to the folding frame;

(ii) a rear end;

(iii) a pivot member pivotally connected to an inner surface of the folding frame facing the seat;

(iv) a motor secured to the pivot member;

(v) a threaded rod driven by the motor;

(vi) a holder having a threaded hole for receiving the threaded rod, the threaded rod being extendable and retractable relative to the holder;

(2) a second actuator, the second actuator being a motorized fader having:

(i) a front end secured to the rear end of the first actuator;

(ii) a rear end pivotally connected to the seat;

(iii) a cylindrical body pivotally connected to the seat;

(iv) a telescopic rod being extendable and retractable relative to the cylindrical body; and wherein the first actuator and the second actuator can be actuated to pivot the folding frame relative to the seat such that the folding frame can be pivoted to a horizontal plane in which the seat lies.

2. The foldable leg rest as claimed in claim 1, wherein the drive mechanism includes a joint having:

(a) a front end secured to the holder of the first actuator; and (b) a rear end secured to a front end of the telescopic rod of the second actuator extending from the cylindrical body.

3. The foldable leg rest as claimed in claim 2, wherein the drive mechanism includes a resilient member connected between the seat and the joint.

4. The foldable leg rest as claimed in claim 3, wherein:

an upper eye is mounted on a front portion of a bottom surface of the seat;

a lower eye is mounted on a top of the joint;

the resilient member includes:

(a) an upper hook engaging the upper eye on the seat; and (b) a lower hook engaging the lower eye on the joint.

5. The foldable leg rest as claimed in claim 4, wherein a pivot piece extends downward from a rear portion of the seat and the cylindrical body of the second actuator is pivotally connected to a lower end of the pivot piece.

6. The foldable leg rest as claimed in claim 3, wherein a pivot piece extends downward from a rear portion of the seat and the cylindrical body of the second actuator is pivotally connected to a lower end of the pivot piece.

7. The foldable leg rest as claimed in claim 2, wherein a pivot piece extends downward from a rear portion of the seat and the cylindrical body of the second actuator is pivotally connected to a lower end of the pivot piece.

8. The foldable leg rest as claimed in claim 1, wherein a pivot piece extends downward from a rear portion of the seat and the cylindrical body of the second actuator is pivotally connected to a lower end of the pivot piece.

* * * * *